US009198467B2

(12) United States Patent
Gordon

(10) Patent No.: US 9,198,467 B2
(45) Date of Patent: Dec. 1, 2015

(54) SHAPING GARMENT

(71) Applicant: Paris Gordon, Nashville, TN (US)

(72) Inventor: Paris Gordon, Nashville, TN (US)

( * ) Notice: Subject to any disclaimer, the term of this patent is extended or adjusted under 35 U.S.C. 154(b) by 0 days.

(21) Appl. No.: 14/215,322

(22) Filed: Mar. 17, 2014

(65) Prior Publication Data

US 2014/0273734 A1 Sep. 18, 2014

Related U.S. Application Data

(60) Provisional application No. 61/793,259, filed on Mar. 15, 2013.

(51) Int. Cl.
*A41C 1/06* (2006.01)

(52) U.S. Cl.
CPC ..... *A41C 1/06* (2013.01); *A41B 2400/38* (2013.01)

(58) Field of Classification Search
CPC ..... A41C 1/00
USPC ..... 450/30–33, 28; 66/170, 171, 172 E, 66/175–177; 2/67
See application file for complete search history.

(56) References Cited

U.S. PATENT DOCUMENTS

| | | | | |
|---|---|---|---|---|
| 3,771,172 | A * | 11/1973 | Barg | 2/67 |
| 6,817,034 | B2 * | 11/2004 | Smilovic | 2/73 |
| 7,083,494 | B2 * | 8/2006 | Sandroussi et al. | 450/31 |
| 7,441,418 | B2 * | 10/2008 | Delgado-Mecinas | 66/177 |
| 7,546,751 | B2 * | 6/2009 | Lutz | 66/177 |
| 7,878,881 | B2 * | 2/2011 | Hendrickson | 450/36 |
| 8,226,452 | B2 * | 7/2012 | Hendrickson | 450/30 |
| 8,235,766 | B2 * | 8/2012 | Melarti et al. | 450/155 |
| 2009/0265830 | A1 * | 10/2009 | Hendrickson | 2/104 |
| 2009/0265831 | A1 * | 10/2009 | Hendrickson | 2/104 |
| 2010/0068972 | A1 * | 3/2010 | Hendrickson | 450/36 |
| 2010/0184355 | A1 * | 7/2010 | Kennedy | 450/31 |

* cited by examiner

*Primary Examiner* — Gloria Hale
(74) *Attorney, Agent, or Firm* — C. Brandon Browning; Maynard, Cooper & Gale

(57) ABSTRACT

The present disclosure generally pertains to a shapewear garment with an integrated compression liner. The liner is constructed from a singular tubular piece of fabric and provides 360° of compression. The liner is seamless, thus allowing for a smooth appearance. The liner is attached to an outer fashion garment to prevent twisting or turning of the piece. The garment includes a plurality of yarn stitches to provide greater support in the chest and stomach regions. The liner and outer garment may take a T-shirt or tank top configuration with a number of different necklines and lengths.

23 Claims, 8 Drawing Sheets

SHAPING GARMENT

RELATED APPLICATIONS

This application claims priority to U.S. Provisional Patent Application No. 61/793,259, filed on Mar. 15, 2013 and titled, "Shaping Garment," the entire contents of which are incorporated herein by reference.

FIELD OF THE INVENTION

The present invention is directed to a shape slimming and support garment which includes an inside shaping liner permanently attached to an outer shell fabric that is in the form of fashion apparel.

BACKGROUND OF THE INVENTION

Compression or shaping garments are used to provide support and improve the appearance of the wearer. Conventional shaping pieces are incorporated into undergarments, i.e., worn under clothing, and act to smooth and shape areas of the body. For instance, girdles are used to shape the abdominal area. Additionally, shapewear may take the form or panties or briefs to add support to the lower body areas.

U.S. Patent Application Publication No. 2010/0099332 describes a one piece shapewear garment with a foundation made from compression material. The material comprises at least one area of firm support, at least one are of light support and at least one resealable thong-like seam.

U.S. Patent Application Publication No. 2011/0207382 describes a compression undergarment with a one-piece unit made of front and rear panels cut and sewn along the edge to form a tubular body shaping garment. The material is stretchable in the longitudinal direction and has a lightweight zippered opening along the front.

U.S. Patent Application Publication No. 2012/0144548 describes a shapewear garment made from a stretchable fabric containing a fiber that has a high yield strain and a low hysteresis. The garment is capable of undergoing significant elongation with the ability to recover its original dimensions when not in use.

U.S. Patent Application Publication No. 2012/0129425 describes a shape enhancing garment shell and a garment lining permanently affixed to the shell. The lining is sized to apply compression to the body of the wearer. The garment is lining is made of a circular knot fabric consisting essentially of Spandex and polyester, and a stretch powerknit fabric consisting essentially of Spandex and nylon.

What is needed in the art is a shape enhancing garment that includes a completely integrated compression shell which provides seamless support.

SUMMARY OF THE INVENTION

In one embodiment, the present invention pertains to a shape enhancing garment comprising a liner and an outer shell, where the liner is constructed from a seamless tubular piece of nylon and spandex compression fabric arranged to form bra and girdle portions. In this embodiment, the outer shell and the liner are sewn together. The liner provides compression and support to the body of the wearer. In one embodiment, the liner includes an integrated bra with support stitching placed under the breast portion and sides of the bust. The stitching is comprised of different nylon/spandex combinations and weights. In an additional embodiment, the liner includes compression stitching along the sides of the liner from the arm hole to the bottom hem. The liner and the outer shell may be attached at the neckline and/or at the armhole. In this embodiment, the liner and outer shell contain no other attachment points. The liner and the outer shell may also contain a zipper running vertically along the back portion to aid in dressing and undressing. When a zipper is present, the liner may be coupled along the zipper of the outer shell.

BRIEF DESCRIPTION OF THE DRAWINGS

The disclosure can be better understood with reference to the following drawings. The elements of the drawings are not necessarily to scale relative to each other, emphasis instead being placed upon clearly illustrating the principles of the disclosure. Furthermore, like reference numerals designate corresponding parts throughout the several views.

DETAILED DESCRIPTION OF THE INVENTION

In accordance with various embodiments of the invention, a shaping garment is provided wherein the shaping component, or liner, is integrated into outer fashion apparel or shell, the liner including a bra and girdle portions. One or more attachment points between the two component allows for free movement of the outer shell while insuring a firm and stable fit for the liner. The liner further includes components which enhance the shaping and supporting properties, including particular yarns and stitches.

As used herein, the term garment is accorded its ordinary meaning as is known in the art and may refer to any article of clothing, for example a dress, shirt, gown, skirt, T-shirts, Tank top, etc. In one preferred embodiment, the garment of the invention comprises a T-shirt or tank top.

Figure 1A:
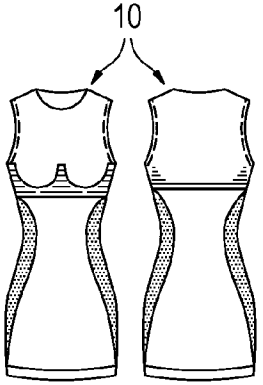
FIG. 1A illustrates a waist-length shaping liner with a scoop neckline in accordance with an embodiment of the invention.
Figure 2A:
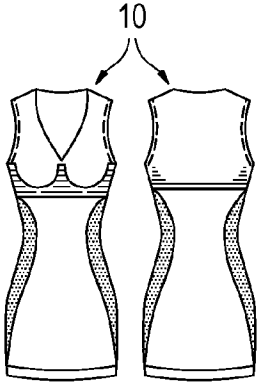
FIG. 2A illustrates a waist-length shaping liner with a V-neckline in accordance with an embodiment of the invention.
Figure 2B:
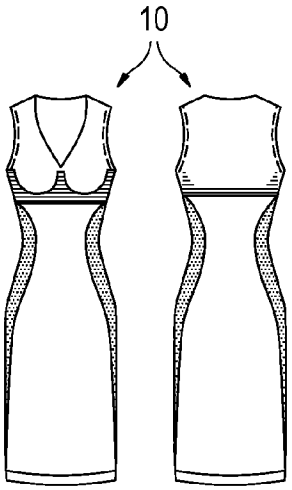
FIG. 2B illustrates a full length shaping liner with a V-neckline in accordance with an embodiment of the invention.
Figure 3A:
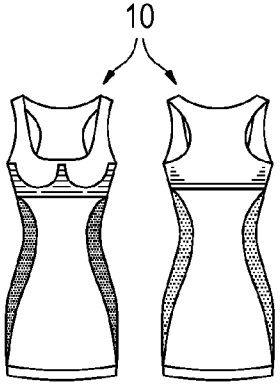
FIG. 3A illustrates a waist-length shaping liner with a razor back tank configuration in accordance with an embodiment of the invention.

Described below, with particular reference to the figures, are descriptions of certain embodiments of the presently disclosed garment. FIGS. 1A, 2A and 3A (front view) and FIGS. 1B, 2B and 3B (back view) illustrate embodiments of the shaping liner 10. Shaping liner 10 is constructed from a tubular, knitted, seamless fabric. Knit fabrics are made from interlocking loops of thread, which is in contrast to the lengthwise and crosswise weaving of threads found in woven fabrics. The resulting fabric has varying degrees of stretchability, from slight to extreme elasticity. This is provided in part by constricting the fabrics and/or yarns, removing or adding stitches. Knit fabrics have the ability to drape well on any body type, and offer smoothing of the body silhouette and breast support. Along with degrees of stretch, this knit fabric is made of different nylon and spandex fibers and come in a variety of weights.

In one exemplary embodiment, the shaping liner 10 illustrated in FIGS. 1-3 is constructed from a knit fabric including nylon and Spandex. Spandex is a synthetic fiber known for its exceptional elasticity. Because of its elastic and compression characteristics, Spandex is an appropriate fabric for the construction of apparel and clothing articles where stretch is desired, generally for comfort and fit. Nylon is very much suitable for hosiery and knitted fabrics because of its smoothness, light weight and high strength. Both nylon and Spandex stretch along and compress the wearer's body. As described in more detail below, the garment further comprises other aspects to enhance the shaping and supporting properties. Liner 10 is manufactured from a single tubular piece of fabric and thus provides 360° of compression and support of the body silhouette without seams, contributing to the smoothing characteristics of the garment.

Figure 1B:
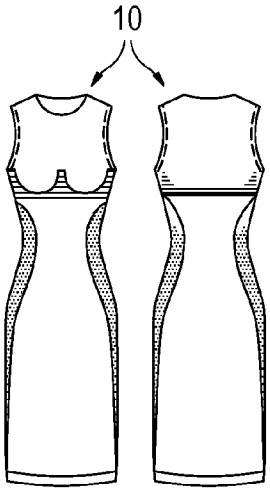
FIG. 1B illustrates a full length shaping liner with a scoop-neckline in accordance with an embodiment of the invention.
Figure 3B:
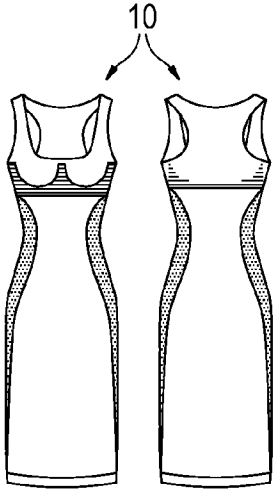
FIG. 3B illustrates a full length shaping liner with a razor back tank configuration in accordance with an embodiment of the invention.

The liner 10 embodied in FIGS. 1A and 1B illustrates a scoop type neckline. Other types of necklines, such as a V-neck (FIGS. 2A and 2B), deep scoop neck, key hole neck, strapless and racer back tank (FIGS. 3A and 3B) are also possible. One of skill in the art will recognize that other necklines are contemplated by the invention, which is not limited to the necklines specifically illustrated. FIGS. 1A, 2A and 3A illustrate embodiments where the liner 10 is waist-length. Here, the liner extends just beyond the waist line to above the hip area. In this embodiment, liner 10 is incorporated into shorter garments, for example shirts, t-shirts, or other tops. FIGS. 1B, 2B and 3B illustrate an embodiment of liner 10 with a longer length, for instance extending over the waist or the thigh, stopping above the knee. In this embodiment, liner 10 is incorporated into garments with a longer length, for example skirts and dresses. One of skill in the art will recognize that the liner may be of any length to provide compression and contouring, such length not limited by the embodiments illustrated in the aforementioned figures. The waist length liners (FIGS. 1A, 2A and 3A) supports the breasts (as described in more detail below), flattens the stomach and smooths the figure of the wearer by providing 360° of compression. The longer length liner (FIGS. 1B, 2B and 3B) provides the same advantages as the waist-length liner but also smooths and compresses the wearer's hips, thighs and backside.

Figure 4A:
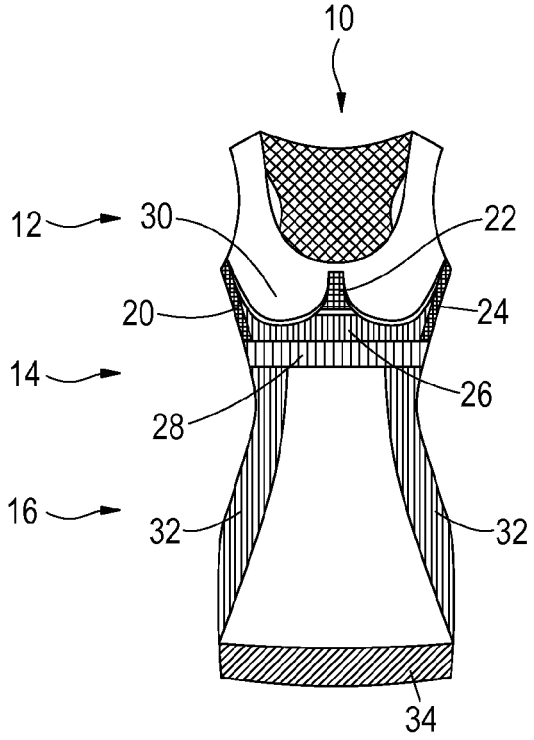
FIG. 4A illustrates a front view of a waist-length racer back tank liner in accordance with an embodiment of the invention.
Figure 4B:
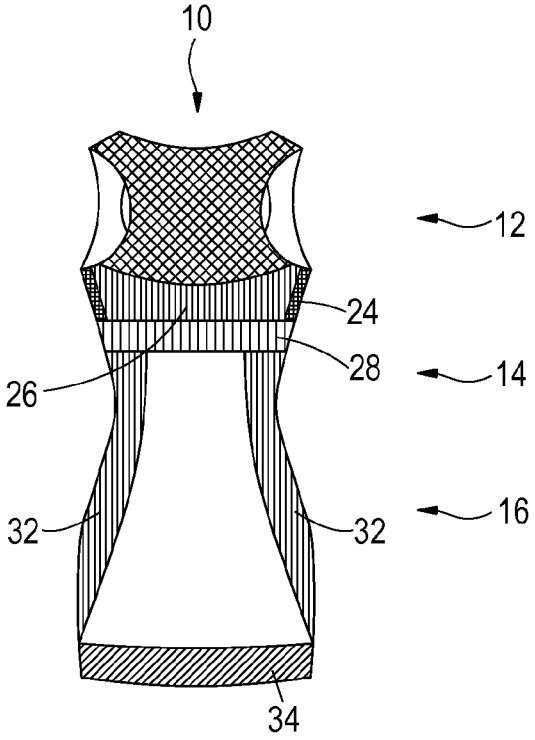
FIG. 4B illustrates a back view of a waist-length racer back tank liner in accordance with an embodiment of the invention.

Line 10 further includes a series or pattern of stitches to provide additional shaping and support. These series or patterns of stitching are illustrated in FIGS. 4A and 4B. The stitching embodied in this figure is accomplished with various types of yarns. Yarn is a long continuous length of interlocked fibers, suitable for use in the production of textiles, sewing, crocheting, knitting, weaving and embroidery.

FIG. 2 illustrates the front face (FIG. 4A) and back face (FIG. 4B) of a liner 10 with a racer-back tank configuration. One of skill in the art will understand that liner 10 may incorporate any number of configurations and is not limited to the racer-back tank illustrated in this figure. The upper portion 12 of liner 10 is referred to as the bra support area. The lower portion 16 is the hip and waist control area, while center portion 14 separates the upper and lower parts.

Figure 5:
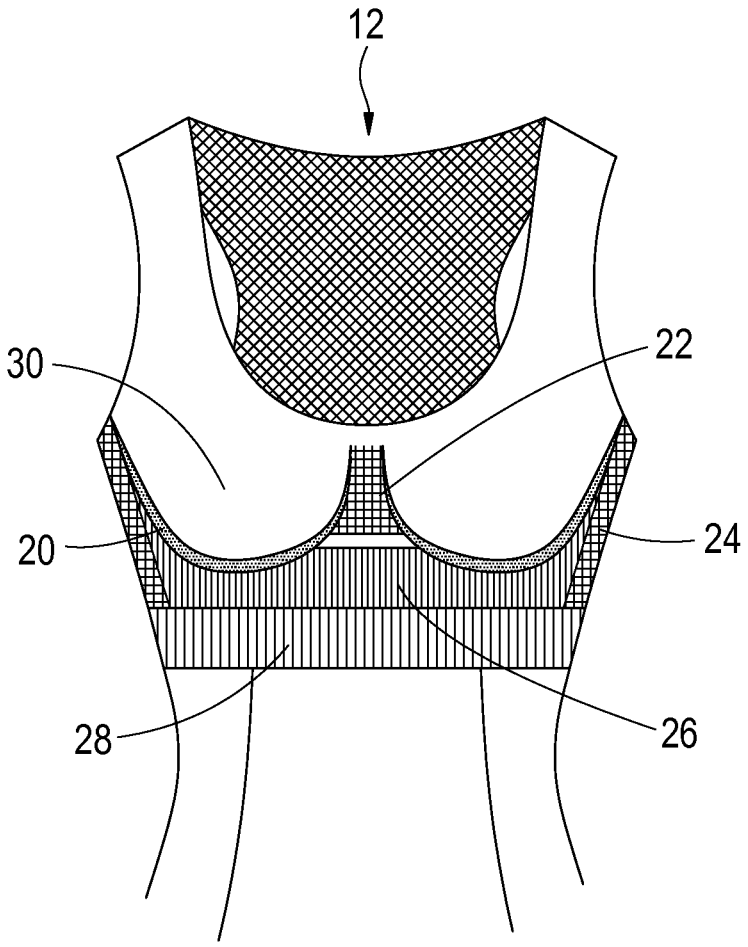
FIG. 5 illustrates a detailed front view of the upper support area of a liner in accordance with an embodiment of the invention.

FIG. 5 illustrates a detailed view of the upper or bra support area 12. Liner 10 includes an underwire stitch 20 and a side bust holding stitch which provide support and lift for the breasts. Center bust holding stitch 22 and side bust control stitch act to pull the breasts towards the center of the liner 10 and hold the breasts in place. In one embodiment, the center under bust holding stitch begins approximately one inch below the neckline and extends downward to the under bust stitch 26, which encircles to the back of the liner 10 (FIG. 5B) and further supports with compression the under bust area. Side bust control stitch 24 extends from the top of under bust control stitch 26 to the arm hole or just below the arm hole to provide control along the side of the bust. A shining stitch 30 is centered on the bust area of the liner 10. In this embodiment, the shining stitch 30 includes one or more rows of gathers and is used to create the fullness of the breasts. Use of shining stitch creates a bra "cup" and acts to hold and secure the breast. The combination of the above described stitches provides a built in bra that is integrated into the shell and is not a separate piece, complete with side compression, center support and underwire-like support. As a result, the line 10 of the present invention may be worn with or without the use of a bra.

In one embodiment, the stitching yarns describe above and incorporated into top portion 12 are fabricated from two ends of 20 denier 20 filament nylon+30 denier Spandex single covered, with a 12 denier 7 filament covering (i.e., 2/20/20+30/12/7). Denier is a unit of measure for the linear mass density of fibers and defined as the mass in grams per 9,000 meters. The denier is based on a natural standard—i.e., a single strand of silk is approximately one denier. A 9,000-meter strand of silk weighs about one gram. Applied to yarn, a denier is equal in weight to 1/24 of an ounce. One of skill in the art will recognize that other combinations and weights of yarn may be used in the present invention.

Referring again to FIGS. 4A, 4*b*, the center portion 14 of liner 10 includes a bra band stitch 28. In one embodiment, this stitch is approximately 1¼ to 1½ inches wide and extends around to the back of the hem of liner 10 (FIG. 4B). This acts as the lower band of a conventional bra, adding support to the breasts. The stitching yarns described above for center portion 14 and incorporated liner 10 are fabricated from two ends of 20 denier 20 filament nylon+30 denier Spandex single covered, with a 12 denier 7 filament covering and a 210 denier Spandex single covered with 15 denier, 7 filament nylon (i.e., 2/20/20+30/12/7+210/15/7). One of skill in the art will recognize that other combinations and weights of yarn may be used in the present invention.

The lower portion 16 of liner 10 includes a side compression stitch 32. This stitch 32 extends along the sides of liner 10, beginning at the lower edge of the bra band stitch 28 and continuing the length of the liner 10. In the waist-length embodiments exemplified by FIGS. 1A, 2A and 3A, side compression stitch 32 compresses and support the waist area. In the full-length embodiments illustrated by FIGS. 1B, 2B and 3B, side stitch 32 adds additional compression and support to the back side and thigh areas.

The bottom-most edge of liner 10 includes hem line 34, where the edge of a piece of the liner 10 fabric is folded narrowly and sewn to prevent unraveling. A silicone band may be provided on the inside of the hem line for adhering to the body of a wearer to prevent slipping of the liner. In one embodiment, hem 32 is approximately two inches wide. One of skill in the art will recognize that alternate hem lengths are possible and the current invention is not limited by any one particular hem length. In one embodiment, hem 32 may include a silicone non-stick piece placed inside the hem line to provide greater stability and rigidity.

In one embodiment, the stitching yarns describe above and incorporated into lower portion 16 are fabricated from 1 end of 20 denier, 20 filament nylon+30 denier Spandex single covered with 12 denier, 7 filament nylon (1/20/20+30/12/7). One of skill in the art will recognize that other combinations and weights of yarn may be used in the present invention.

Figure 6A:
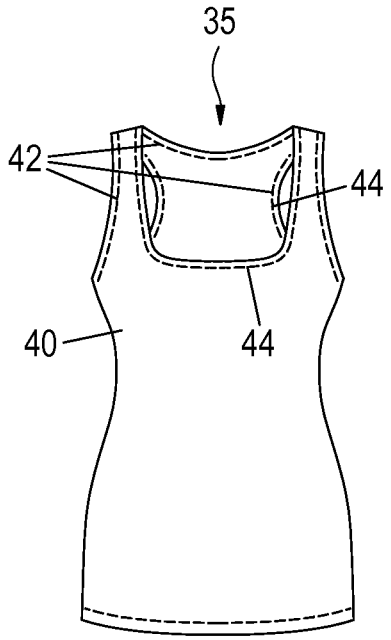
FIG. 6A illustrates a front view of a racer back tank outer garment in accordance with an embodiment of the invention.
Figure 6B:
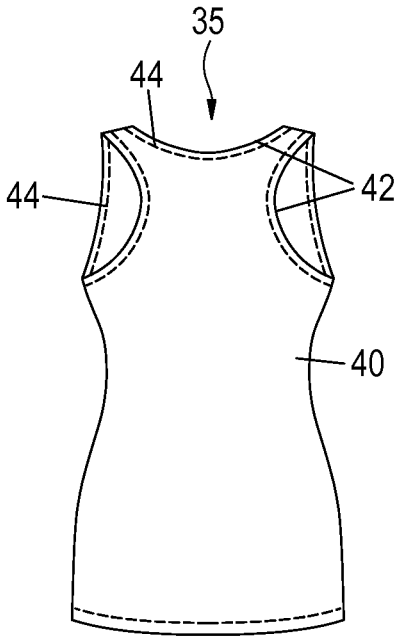
FIG. 6B illustrates a back view of a racer back tank outer garment in accordance with an embodiment of the invention.
Figure 6C:
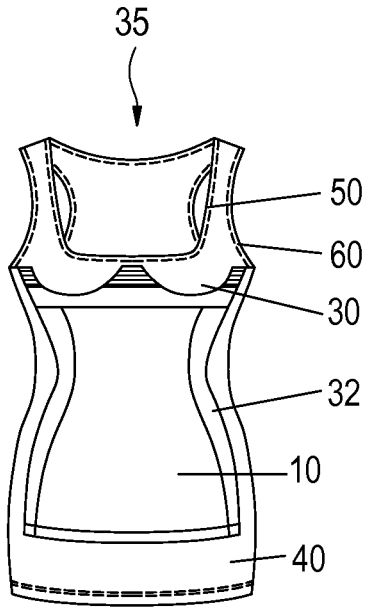
FIG. 6C illustrates a liner of a racer back tank in accordance with an embodiment of the invention.

Unlike many prior art compression garments, the liner 10 of the present invention is attached or connected to the inside of an outer fashion garment shell 40. FIGS. 4A, 6B and 6C illustrate a racer back tank embodiment of the garment 35 incorporating both the liner 10 and the outer shell 40. FIG. 6A illustrates a front face view of the outer shell 40, FIG. 6B illustrates a back side view of the outer shell 40, and FIG. 6C illustrates an internal view of the outside shell 40 with the attached liner 10. Outer shell 40 may take the form of any fashion garment. Although the garment 35 illustrated in FIGS. 6A-6C takes the form of a racer back tank top, other fashion garments are possible, such as a shirt, gown, t-shirt, dress or tank top. Outer shell 40 may be fabricated from any material suitable for constructing fashion wear, as in known in the art. For example, outer shell 40 may comprise knitted cotton, bamboo, linen or wool fabrics. In another embodiment, outer shell 40 is constructed of a material suitable for active uses, for instance exercising. Such fabrics may include Spandex or Spandex knit mixes. It is to be understood that other fabrics may be utilized for use in outer shell 40.

Turning again to FIGS. 6A and 6B, garment 35 includes an outer shell 10 and inner shaping liner 20. Here, liner 10 is integrated into the outer shell 40 and is not a separate garment. Shell 40 may include a double needle overlock marrow seam 42 placed at the neckline and armholes. In one embodiment, a material may be added to the seam to increase durability. For example, a Mobilon elastic strip may be incorporated into the seam 42. Mobilon strips are made from a polyurethane elastic material and have superior elongation and breaking strength, good resistance to mildew, UV rays, dry cleaning, bleach etc. Topstitch 44 is incorporated at the neckline and armholes near marrow seam 42 to prevent the liner fabric 40 from slipping and to provide a crisp edge. The outer shell 40 may also include a double needle coverstitch 46 at the bottom hem.

FIG. 6C illustrates an internal view of the outside shell 40 with the attached liner 10. Here, the liner 10 is secured to the outer shell 40 at the neckline 50 and the armhole 60. In this embodiment, the liner 10 is preferably free of other attachment to the outer shell 40 such that the shell 40 may move relatively freely from the liner 10. Attachment at the neckline 50 and armhole 60 allows the outer shell to flow naturally around the wearer but also prevents the outer shell 40 from becoming twisted. As described previously, one of skill in the art will recognize that the liner may be of any length, i.e., covering just the abdominal area or also covering the backside, hip and thigh area.

Figure 7A:
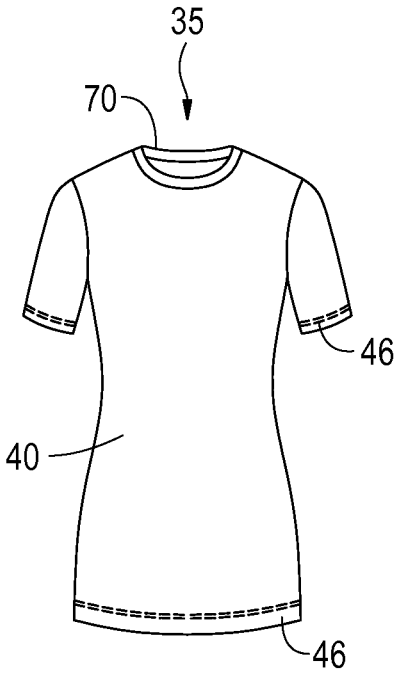
FIG. 7A illustrates a front view of a scoop neck T-shirt outer garment in accordance with an embodiment of the invention.
Figure 7B:
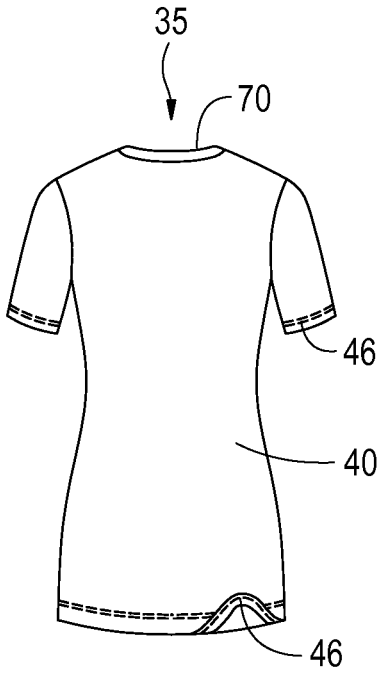
FIG. 7B illustrates a back view of a scoop neck T-shirt outer garment in accordance with an embodiment of the invention.
Figure 7C:
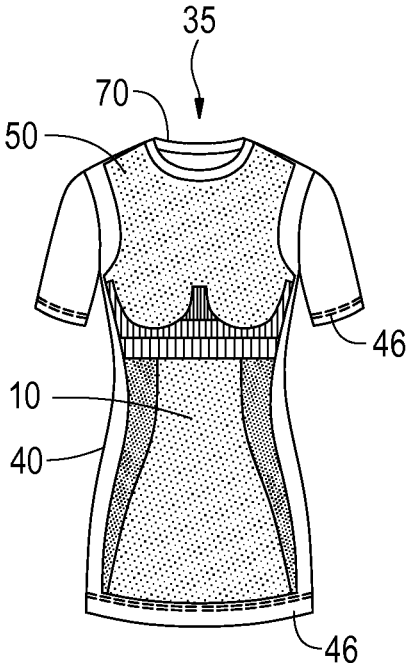
FIG. 7C illustrates a front view of scoop neck T-shirt outer garment with an integrated liner in accordance with an embodiment of the invention.
Figure 7D:
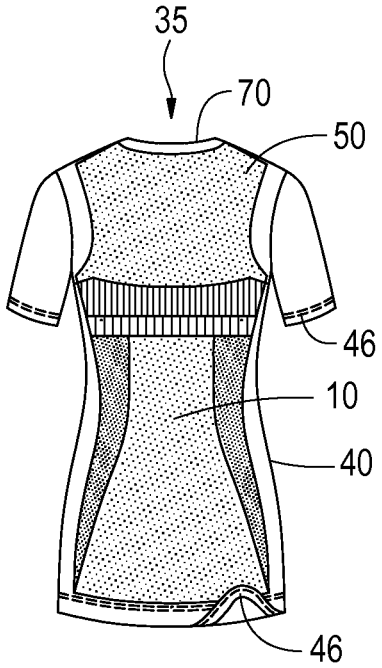
FIG. 7D illustrates a back view of scoop neck T-shirt outer garment with an integrated liner in accordance with an embodiment of the invention.

FIGS. 7A-7D illustrate a scoop neck tunic T-shirt embodiment of the garment 35 incorporating both the liner 10 and the outer shell 40. FIG. 7A illustrates a front face view of the outer shell 40, FIG. 5B illustrates a back side view of the outer shell 40, FIG. 7C illustrates an internal front face view of the outside shell 40 with the attached liner 10 and FIG. 7D illustrates an internal back view of the outside shell 40 with the attached liner 10. Although the embodiment illustrated in FIGS. 7A-7D contemplates short sleeve, long sleeve or three-quarter sleeves are also contemplated. As described above for the racer tank embodiment, liner 10 is integrated into the outer shell 40 and is not a separate garment. Shell 40 may include a neckband placed at the neckline 70, which provides a smooth finish for the curved neckband. The outer shell 40 may also include a double needle coverstitch 46 at the bottom hem.

FIGS. 7C and 7D illustrate an internal view of the outside shell 40 with the attached liner 10. In contrast to the racer back tank embodiment, the liner 10 is secured to the outer shell 40 only at the neckline 50 through an edge stitch on the lining. The liner 10 is preferably free of other attachment to the outer shell 40 such that the shell 40 may move relatively freely from the liner 10. Attachment at the neckline 50 allows the outer shell to flow naturally around the wearer but also prevents the outer shell 40 from becoming twisted. One of skill in the art will recognize that the liner may be of any length, i.e., covering just the abdominal area or also covering the backside and thigh area.

Figure 8A:
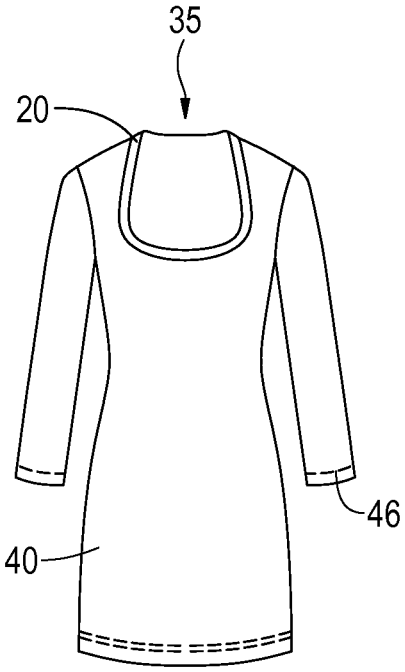
FIG. 8A illustrates a front view of a deep scoop neck T-shirt outer garment in accordance with an embodiment of the invention.
Figure 8B:
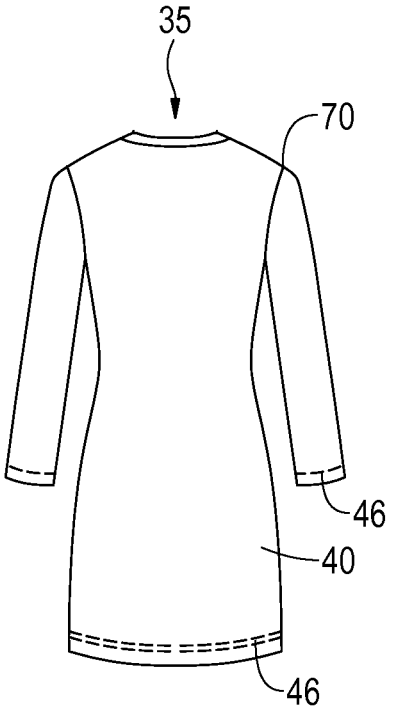
FIG. 8B illustrates a back view of a deep scoop neck T-shirt outer garment in accordance with an embodiment of the invention.
Figure 8C:
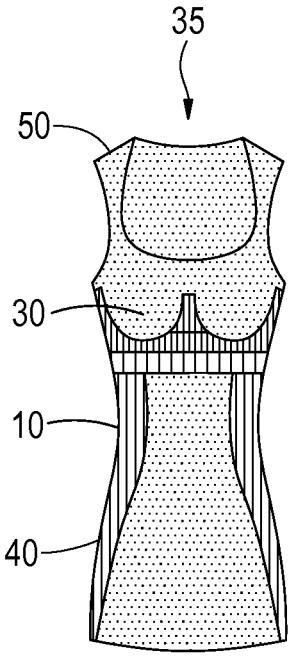
FIG. 8C illustrates a front view of the liner of a deep scoop neck T-shirt in accordance with an embodiment of the invention.

FIGS. 8A-8C illustrate a deep scoop neck t-shirt with the same characteristics described above for FIGS. 7A-7D, with the exception of the length of the neckline 72. In this embodiment, the neckline 72 is deeper and extends farther down the chest of the wearer. Although the embodiment illustrated in FIGS. 8A-8B incorporates a three-quarter length sleeve, other sleeve lengths such as short or full length are also contemplated.

Figure 9A:
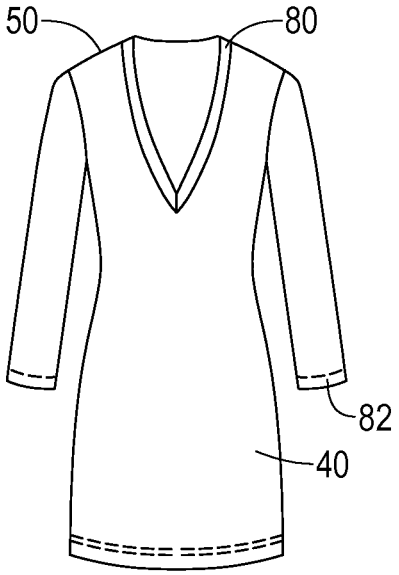
FIG. 9A illustrates a front view of a V-neck T-shirt outer garment in accordance with an embodiment of the invention.
Figure 9B:
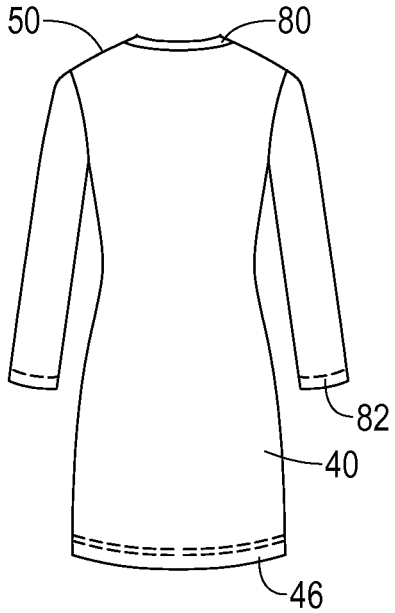
FIG. 9B illustrates a back view of a V-neck T-shirt outer garment in accordance with an embodiment of the invention.
Figure 9C:
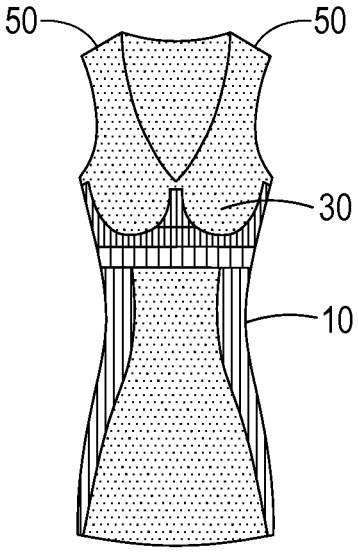
FIG. 9C illustrates a front view of the liner of a V-neck T-shirt in accordance with an embodiment of the invention.

FIGS. 9A, 9B and 9C illustrate a V-neck T-shirt embodiment of the garment 35 with a liner 10 and an outer shell 40. FIG. 9A illustrates a front face view of the outer shell 40, FIG. 9B illustrates a back side view of the outer shell 40, and FIG. 9C illustrates the liner 10. Outer shell 40 may take the form of any fashion garment. Although the garment 35 illustrated in FIGS. 9A-9C takes the form of a V-neck T-shirt, one of skill in the art will understand that other fashion necklines are possible, such as key hole, off-the-shoulder and deep V-neck.

Turning again to FIGS. 9A and 9B, garment 35 includes an outer shell 40 and inner shaping liner 10. As described above, liner 10 is integrated into the outer shell 40 and is not a separate garment. Shell 40 may include a three-eighths inch neck banding 80 placed at the neckline and a one inch double needle cover stitch hem 82 at the sleeve ends. In one embodiment, a material may be added to the neck-line seam to increase durability. For example, a Mobilon elastic strip may be incorporated into the seam 42.

FIG. 9C illustrates the attached liner 10. Here, the liner 10 is secured to the outer shell 40 only at the neckline 50. In this embodiment, the liner 10 is preferably free of other attachment to the outer shell 40 such that the shell 40 may move relatively freely from the liner 10. Attachment at the neckline 50 allows the outer shell to flow naturally around the wearer but also prevents the outer shell 40 from becoming twisted. As described previously, one of skill in the art will recognize that the liner may be of any length, i.e., covering just the abdominal area or also covering the backside, hip and thigh area.

Figure 10A:
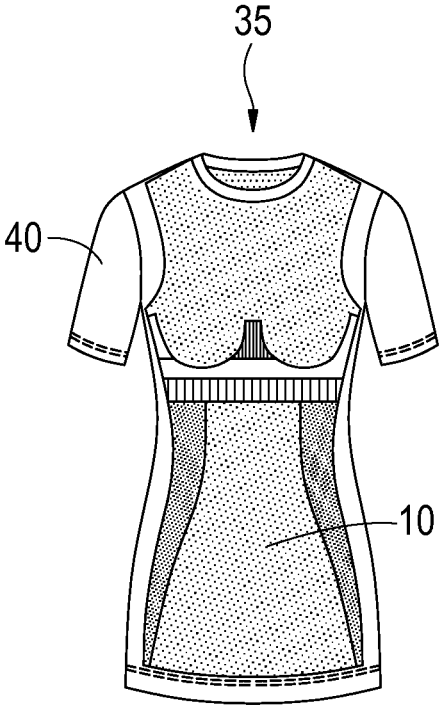
FIG. 10A illustrates a front view of a scoop neck T-Shirt incorporating a zipper in accordance with an embodiment of the invention.
Figure 10B:
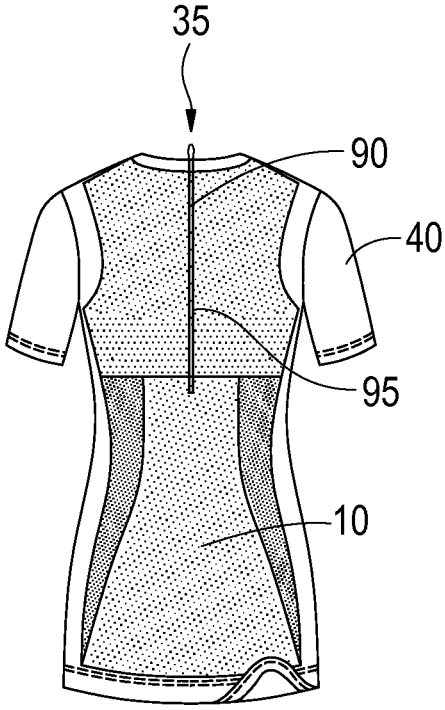
FIG. 10B illustrates a back view of a scoop neck T-Shirt incorporating a zipper in accordance with an embodiment of the invention.

Any of the garments illustrated in FIGS. 1-9 may alternatively include an embodiment incorporating a zipper or other fastening device. FIGS. 10A and 10B illustrate a scoop neck T-shirt garment 35 with an outer shell 40 and a liner 10. As illustrated in FIG. 10B, both the liner 10 and the outer shell 40 include a vertical zipper 90, located at the back center of the garment 35. Zipper 90 allows the user to easily dress and undress using garment 35. In this embodiment, the outer shell 40 and liner 20 include an additional attachment point 95 along the edges of zipper 90. Attachment at the zipper prevents the liner 10 from slipping or moving, and proved stability to the outer shell.

Now, therefore, the following is claimed:

1. A garment comprising:

an outer shell having an outer shell neckline and an outer shell arm hole, a liner constructed from a knitted, seamless tubular compression fabric, the liner including an integrated bra, a hip and waist control portion, a center portion located between the integrated bra and the hip and waist control portion, a front face, a back face, a liner neckline and a liner arm hole, a first seam attaching the liner to the outer shell, and a plurality of knitted liner stitches configured for shaping and supporting a wearer's breasts and compressing a wearer's body at desired areas, the desired areas including the wearer's waist and hips.

2. The garment of claim 1 wherein the outer shell is selected from the group consisting of a gown, a dress, a tank-top and a T-shirt.

3. The garment of claim 1 wherein the liner neckline is selected from the group consisting of a scoop neckline, a V-neck neckline, a deep scoop neckline, a key hole neckline and tank neckline.

4. The garment of claim 1 wherein the integrated bra of the liner includes an underwire stitching that forms a cup portion for receiving a wearer's breast.

5. The garment of claim 1 wherein the integrated bra of the liner includes a side bust holding stitching and an opposing side bust hold stitching.

6. The garment of claim 1 wherein the integrated bra of the liner includes a center bust holding stitching located between a first cup portion and a second cup portion of the integrated bra.

7. The garment of claim 6 wherein the center bust holding stitching extends from about 1 inch below the liner neckline to an under bust control stitching of the integrated bra.

8. The garment of claim 7 wherein the under bust control stitching extends partially around the liner and to and between a side bust holding stitching and an opposing side bust hold stitching.

9. The garment of claim 5 wherein the side bust holding stitching extends to and between the liner arm hole and an under bust control stitching of the integrated bra.

10. The garment of claim 1 wherein the integrated bra includes a bra cup formed at least in part by a shining control stitching.

11. The garment of claim 1 wherein the center portion includes a bra band stitching that extends around the liner and along the front face and the back face of the liner.

12. The garment of claim 11 wherein the bra band stitching is about 1.25 inches to about 1.5 inches wide.

13. The garment of claim 1 wherein the hip and waist control portion includes a compression stitching and an opposing compression stitching.

14. The garment of claim 13 wherein the compression stitching extends along a side of the liner beginning at a lower edge of a bra band stitching and extending to a bottom edge section of the liner and the opposing compression stitching extends along an opposing side of the liner beginning at a lower edge of the bra band stitching and extending to an opposing bottom edge section of the liner.

15. The garment of claim 1 wherein the liner includes a hem along a bottom-most edge of the liner and a piece of silicone extending along the hem.

16. The garment of claim 1 wherein the first seam extends along and between the outer shell neckline and the liner neck line.

17. The garment of claim 16 wherein the garment is free of any locations of attachment between the outer shell and the liner other than the first seam.

18. The garment of 16 wherein the first seam extends entirely around the liner neck line.

19. The garment of claim 1 wherein the first seam extends along and between the outer shell arm hole and the liner arm hole.

20. The garment of clam 19 wherein the first seam extends entirely around the liner arm hole.

21. The garment of claim 19 wherein the outer shell includes a second outer shell arm hole, the liner includes a second liner arm hole, and the garment includes a second seam extending along and between the second outer shell arm hole and the second liner arm hole.

22. The garment of claim 21 comprising a third seam extending along and between the outer shell neckline and the liner neck line, wherein the garment is free of any locations of attachment between the outer shell and the liner other than the first seam, the second seam and the third seam.

23. A garment comprising:

an outer shell having an outer shell neckline, a liner constructed from a seamless tubular piece of knitted, elastic fabric, the liner including an integrated bra portion, a hip and waist control portion, a center portion located between the integrated bra and the hip and waist control portion, a liner neckline, a liner arm hole and an opposing liner arm hole, and a first seam attaching the liner to the outer shell, the first seam extending along and between the outer shell neckline and the liner neckline, wherein the integrated bra portion includes a side bust holding stitching, an opposing side bust holding stitching, a center bust holding stitching, and an under bust control stitching, the side bust holding stitching extending between the liner arm hole and the under bust control stitching, the opposing side bust holding stitching extending between the opposing liner arm hole and the under bust control stitching, and the center bust holding stitching extending from below the liner neckline to the under bust control stitching, wherein the hip and waist control portion includes a bra band stitching extending around the liner, and wherein the hip and waist control portion includes a compression stitching that extends along a side of the liner beginning at a lower edge of a bra band stitching and extending to a bottom edge portion of the liner and an opposing compression stitching that extends along an opposing side of the liner beginning at the lower edge of a bra band stitching and extending to the bottom edge portion of the liner.

* * * * *